US005546782A

United States Patent [19]

Di Giusto

[11] Patent Number: 5,546,782

[45] Date of Patent: Aug. 20, 1996

[54] MACHINE TO SHARPEN BARS TO A POINT

[75] Inventor: Bruno Di Giusto, Udine, Italy

[73] Assignee: Danieli & C. Officine Meccaniche SpA, Buttrio, Italy

[21] Appl. No.: 309,155

[22] Filed: Sep. 20, 1994

[30] Foreign Application Priority Data

Sep. 28, 1993 [IT] Italy ..... UD93A0195

[51] Int. Cl.[6] ..... B21B 31/07; B21B 15/00

[52] U.S. Cl. ..... 72/240; 72/198; 72/234; 72/12.8

[58] Field of Search ..... 74/29; 72/15, 78, 72/198, 234, 237, 240

[56] References Cited

U.S. PATENT DOCUMENTS

| | | | |
|---|---|---|---|
| 2,011,802 | 8/1935 | Dieschier | 72/15 |
| 3,729,973 | 5/1973 | Wykes | 72/234 |
| 4,041,749 | 8/1977 | Veitl | 72/198 |
| 4,106,352 | 8/1978 | Arndt . | |

FOREIGN PATENT DOCUMENTS 559766 12/1943 Germany .

OTHER PUBLICATIONS

Soviet Inventions Illustrated, Week 12, May 5, 1982, Derwent Publications Ltd., London GB & SU-A-835554.

*Primary Examiner*—W. Donald Bray
*Attorney, Agent, or Firm*—Antonelli, Terry, Stout & Kraus

[57] ABSTRACT

Machine to sharpen bars to a point, especially bars to be drawn, which comprises at least one sharpening assembly and at least one assembly for displacement of the bar in relation to the sharpening assembly, the sharpening assembly (31) consisting of two counterpart rolls (11) each of which contains on the plane of positioning of the bar a groove (24) including at least two sections of reduction, means (14–15) being comprised for the circumferential positioning of the rolls (11) at the desired section of reduction, there also being included at least one rolling assembly (**27*a*) upstream of the sharpening assembly (31) and at least one rolling assembly (27*b*) downstream of the sharpening assembly (31), such rolling assemblies (27**) operating on the bar on a plane substantially at a right angle to the plane of reduction.

13 Claims, 2 Drawing Sheets

MACHINE TO SHARPEN BARS TO A POINT

BACKGROUND OF THE INVENTION

This invention concerns a machine to sharpen bars to a point. To be more exact, the machine to sharpen bars according to the invention is suitable to reduce the cross-section of the leading end segment of bars.

Where the sharpening machine is employed in cooperation with a drawing machine, the sharpening of the leading end segment of bars is necessary to enable the bars to pass through the drawing die and to be attached to the drawing trolley of the drawing machine.

The machine can also be used whenever it is necessary to prepare solid or hollow bars with a leading end segment of a reduced section.

The invention is applied to bars having a round, square, polygonal, etc. cross-section.

The invention is also applied to the fields of hot drawing and cold drawing.

The state of the art covers various systems to provide on a bar a leading end segment which is compatible with the size of the drawing die so as to enable the bar to pass through the die and be coupled to the drawing trolley of the drawing machine.

In a first solution of the problem, the state of the art predraws the bar by thrusting it against the die. In this way the leading segment of the bar is formed by the die itself. This system is restricted to certain dimensions of the cross-section of the bar due to the obvious problems of combined bending and compressive stresses, and can be employed only with some materials inasmuch as a swollen mass often forms upstream of the drawing die while the bar is being thrust against the die.

A variant of this method disclosed, for instance, in FR-A-942.599 and DE-B2.758.137 provides for an initial pre-drawing and a subsequent drawing by reverse drawing by using the drawing die, but this variant too entails the same problems as those cited above.

A further disclosure of the state of the art arranges to weld to the leading end of the bar a stub suitable to cooperate with the die, but this system is very expensive and slow and entails undesirable structural changes of the metal.

Another method used is to roll the leading end of the bar by using specially shaped and cut rolls and by making the bar move forward and rotate about its axis at the same time. But this system too is slow, requires a constant control by the machine operator and involves problems of the homogeneity of the finished product.

A further method arranges to remove a shaving from the leading end segment of the bar, but here there are obvious problems linked to the waste, the possibility of tearing, the quality of the leading end segment, wear, etc.

SUMMARY OF THE INVENTION

The present applicants have designed, tested and embodied this invention so as to provide a system to sharpen to a point the leading end segment of the bar, the system being capable of overcoming the problems encountered in the state of the art and of achieving further advantages which are made clear in the description that follows.

The purpose of the invention is to provide a sharpening machine in which the insertion and initial positioning of the bar are made very easy.

Another purpose is to perform the operation of sharpening to a point by drawing the bar and not by thrusting it.

Yet another purpose is to provide a machine which enables the sharpening section to be made variable with simple methods which can be carried out in very short times.

A further purpose is to perform the sharpening to a point mechanically with methods which make possible a substantially perfect cross-section.

The machine to sharpen bars to a point according to the invention includes a pair of rolls positioned as counterparts and circumferentially tangent, their axes being parallel.

At least one of the rolls includes means to position and to thrust that roll radially in relation to the other roll of the pair; this radial thrust has the purpose of eliminating the play which becomes created during working between one roll and the other roll, especially in the zones of the rolls not affected by the action on the bar.

The two rolls have a circumferential development equipped with reciprocally mating grooves having a progressively increasing depth and section.

According to the invention, the grooves include a plurality of connected steps having a constant depth and section, each step corresponding to a working position.

This embodiment makes possible, on each roll, the definition of an interval of the groove corresponding to a given constant reduction of section of the bar.

According to a variant, the depth and section of the groove vary continuously and constantly between a maximum value and a minimum value which determine the range of use of the sharpening machine according to the invention.

The reduction of section in each pass of the bar between the sharpening rolls depends on the type of material constituting the bar, that is to say, its specific strength and quality.

Where there is a continuous variation of the depth of the groove; this variation can be expressed with a plurality of desired values such as millimeters or percentages of reduction so as to pre-set the value of the reduction of section to be achieved with the sharpening operation.

In this connection, the rolls may include setting means, which determine the circumferential position of the rolls and thus position the groove on the basis of the reduction of section desired.

According to the invention, one roll of the pair of rolls is powered by a motor, whereas the other roll, advantageously the radially positionable roll, is a driven roll.

The motor associated with the setting means is actuated in the initial step to bring the rolls to the position of introduction of bars, for instance with the grooves of the rolls in the position of maximum depth and section, and is also actuated in the sharpening step so as to rotate the rolls until the reduction of section set by the setting means has been achieved. This setting can be done by hand or be managed electronically by means of an encoder.

The rolls comprise coordinated gearwheels on their axes so that the rotation imparted to the powered roll is transmitted equally but in the opposite direction to the driven roll.

According to the invention, the rolls cooperate with a drawing assembly including gripper means, which lie on the same plane as the plane containing a line at a tangent to and between the two rolls.

The gripper means are associated with means that determine the width of clamping of the gripper means, these further means being capable of being adjusted according to the dimension of the bar being processed; the gripper means can be anchored and can retain the bar during the drawing step.

The gripper means are associated with drawing means, which draw the bar when the sharpening rolls have been positioned with the desired setting and when the gripper means are in the position of retaining the bar.

According to a variant, the sharpening assembly is associated both upstream and downstream with at least one rolling assembly consisting of at least one pair of rolling rolls arranged with their axis at a right angle to the axis of the sharpening rolls.

In particular, the rolling assembly located upstream of the sharpening rolls has the task of readying the bar for the sharpening operation, whereas the rolling assembly located downstream has the purpose of finishing the sharpened and pointed end segment of the bar so as to remove, for instance, any burrs resulting from the sharpening operation.

According to another variant a plurality of rolling mill stands, advantageously four or more, are included at least upstream of the sharpening assembly and are arranged with their axes rotated in relation to each other.

Each of these rolling mill stands carries out a pre-buckling of the bar on the relative circumferential zones of the same, thus readying the bar for the subsequent sharpening to a point.

BRIEF DESCRIPTION OF THE DRAWINGS

The attached figures are given as a non-restrictive example and show a preferred embodiment of the invention as follows.

DETAILED DESCRIPTION OF THE PREFERRED EMBODIMENTS

Figure 1:
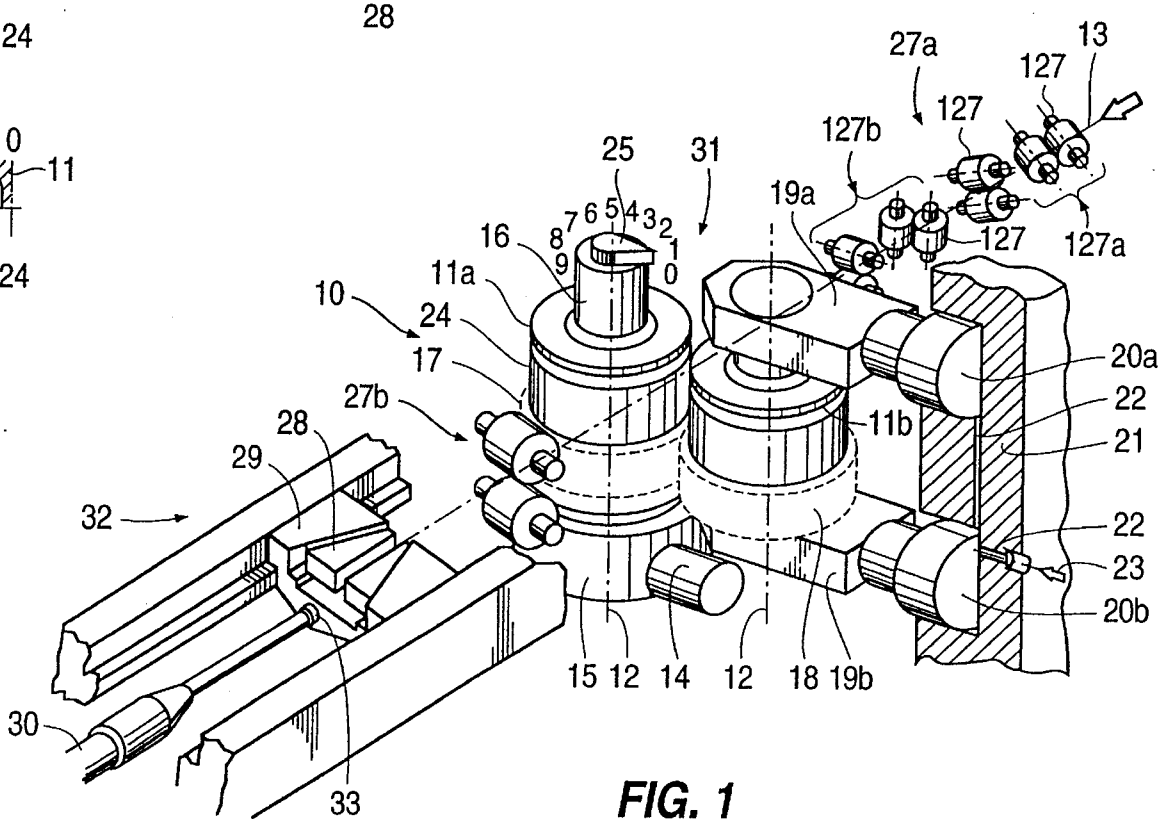
FIG. 1 is a three-dimensional view of the sharpening machine according to the invention.
Figure 4:
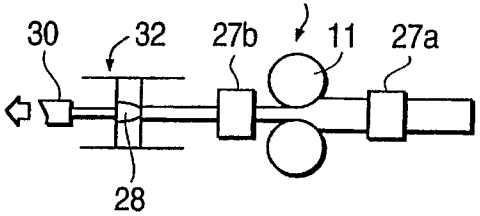
FIG. 4 is a diagram of the method of working of the sharpening machine of FIG. 1.

A sharpening machine 10 to sharpen bars to a point is shown in FIG. 1 and consists essentially of a sharpening assembly 31 and a drawing assembly 32.

In this example the sharpening assembly 31 comprises a pair of circumferentially tangent rolls 11*a* and 11*b* with their axes 12 parallel to each other and at a right angle to, and equidistant from, the axis of feed 13 of the bar being processed.

The axis of feed 13 of the bar passes through the point where the rolls 11 are tangent.

In this example the roll 11*a* is powered and is associated with a motor 14 cooperating with a speed reduction unit 15 associated with a drive shaft 16.

The powered roll 11*a* includes on its axis a powered gearwheel 17 associated and cooperating with a driven gearwheel 18 associated axially with the driven roll 11*b*.

The powered 17 and driven 18 gearwheels transmit the rotation, imparted by the motor 14 to the powered roll 11*a*, in the same way and in the opposite direction to the driven roll 11*b*.

The driven roll 11*b* is associated with means that eliminate the play between the powered roll 11*a* and the driven roll 11*b*.

In this case, these play-elimination means consist of guiding slide blocks 19, an upper slide block 19*a* and a lower slide block 19*b* respectively, which are associated with respective actuator pistons 20, an upper piston 20*a* and a lower piston 20*b*.

These guiding slide blocks 19 can move on a plane substantially at a right angle to the axes 12 of the rolls 11.

The pistons 20 are fitted to a base 21 provided with channels 22 for the intake and feed of oil under pressure supplied through a conduit 23.

The rolls 11 are shaped with a circumferential development containing a groove 24 having a progressively increasing depth and section; the grooves 24 are machined opposite to each other on the two rolls 11.

The maximum depth of the grooves 24 determines the maximum dimension of the bar which can be processed by the sharpening assembly 31.

The minimum depth of the grooves 24 determines the minimum dimension of the section which can be produced on the point of the bar.

Figure 2A:
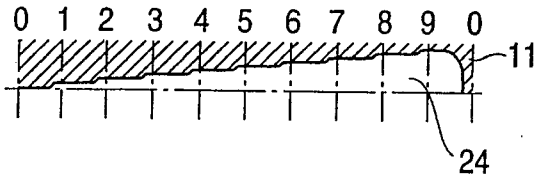
FIGS. 2*a* and 2*b* show the circumferential development of the sharpening rolls with a progressive groove, in steps and continuous respectively.

According to a first embodiment of the invention (FIG. 2*a*) the depth and section of the grooves 24 vary progressively in connected steps, each step corresponding to a working position determining a specific reduction of section.

Figure 2B:
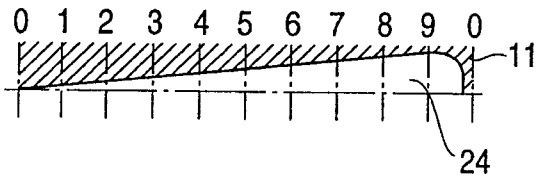

According to a variant (FIG. 2*b*), the depth and section of the grooves 24 vary continuously in a constant and progressive manner.

The progressive reduction of the depth of the grooves 24 determines progressively decreasing values of the half-section of sharpening of the bar; these values can be separated in a desired plurality of values.

Figure 3:
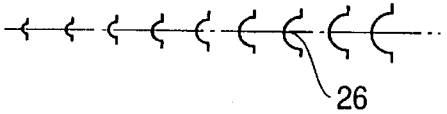
FIG. 3 shows the half-sections produced on the bar being processed, these half-sections corresponding to the positions of the grooves of FIGS. 2.

In the case of the sharpening of cylindrical products to a point, as in the example shown, the half-sections have the form of semi-circular continuous hollows 26 of a dimension coordinated with the position of the groove 24, as shown in FIG. 3.

The powered roll 11*a* includes selector setting means 25, which are associated with the motor 14, to determine the position of the sharpening rolls 11 according to the desired reduction of section.

These selector setting means 25 determine during processing the value of the reduction of section of the leading end segment of the bar to be sharpened according to the requirements and necessities imposed, for instance, by the size of the drawing die.

In this case, there are included, upstream and downstream of the sharpening assembly 31, rolling assemblies 27, namely at least one upstream rolling assembly 27*a* and one downstream rolling assembly 27*b*, which work on the bar to improve the final quality of the sharpening process.

According to the embodiment of FIG. 1, the rolling assembly 27*a* upstream of the sharpening assembly 31 includes four rolling mill stands 127.

In this case, the rolling mill stands 127 are divided into a first upstream pair of stands 127*a* and a second upstream pair of stands 127*b* positioned immediately upstream of the sharpening assembly 31.

The first upstream pair of stands 127*a* has the axes of its rolling mill stands 127 positioned at 45° and 135° respectively to the plane of feed of the bar, whereas the second upstream pair of stands 127*b* has the axes of its rolling mill stands 127 positioned at a right angle and parallel respectively to the plane of feed of the bar.

This lay-out provides an action of pre-buckling of the bar on a plurality of circumferentially separated zones of the bar.

Figure 5:
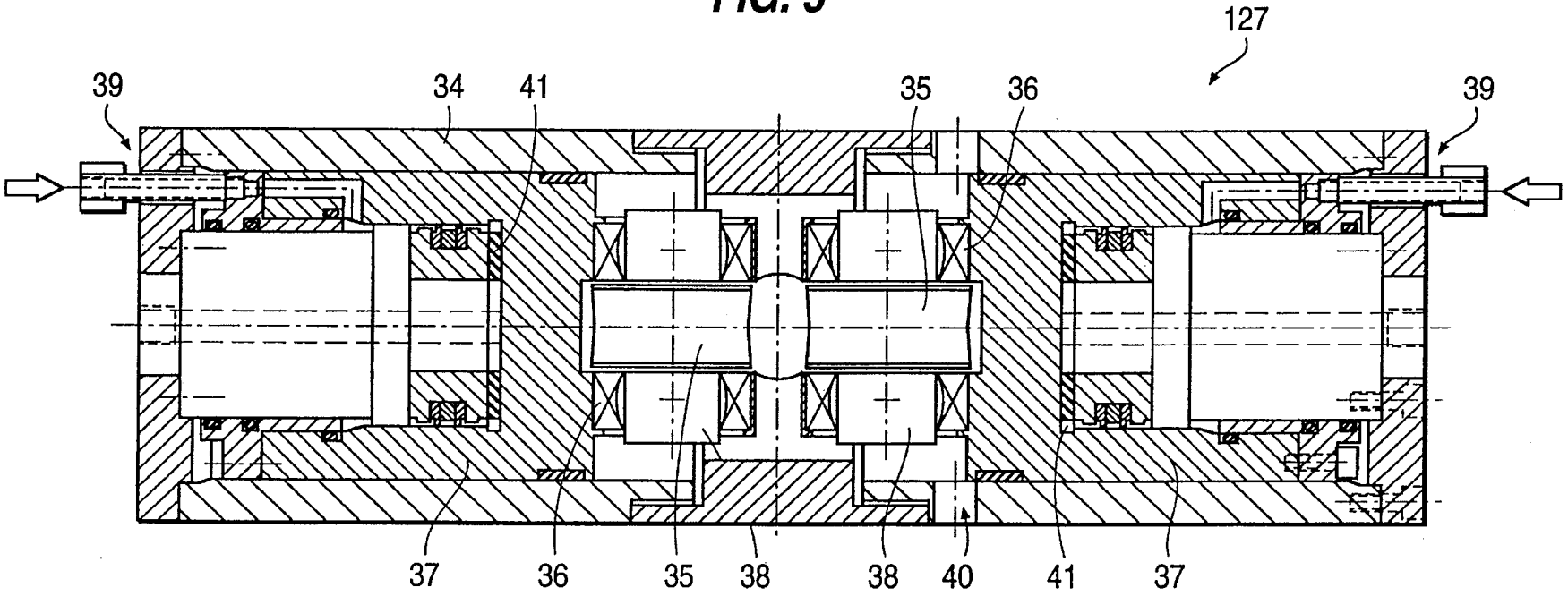
FIG. 5 shows a section of one of the rolling mill stands cooperating with the sharpening assembly according to the invention.

A section of the structure of each of these rolling mill stands 127 is shown in FIG. 5. Each stand 127 consists of a tubular bearing frame 34, within which is located a pair of rolling rolls 35, which are idler rolls and are supported on small shafts 38 borne on spherical joints 36.

The reciprocal approach of the rolling rolls 35 to apply pressure to the bar passing through is carried out by displacement of jackets 37; this displacement is caused by the delivery of fluid under pressure through intake conduits 39.

The rolling mill stand 127 also includes shock absorber means 41 and at least one discharge outlet 40 for scale and other dirt produced by the action of the rolling rolls 35 on the bar.

The drawing assembly 32 is substantially of a known type and includes an engagement gripper 28 associated with a movable wedge-shaped means 29 which adjusts the width of the gripper 28.

The engagement gripper 28 can be associated with hydraulic cylinder means, which are not shown here, in relation to the movable wedge-shaped means 29.

The engagement gripper 28 is associated at its rear at a point 33 of constraint with a drawing cylinder/piston actuator 30.

When the rolls 11 of the sharpening assembly 31 have been positioned circumferentially with the respective grooves 24 mating at the position coinciding with the position of introduction of the bar, the bar is inserted with the segment of bar to be sharpened coinciding with the zone where the rolls 11 touch each other.

The position of insertion of the bar may coincide with the position of maximum depth and section of the grooves 24 or, in any event, with a value of depth greater enough than the nominal diameter of the bar being processed to avoid problems during insertion of the bar.

The engagement gripper 28 is then closed on the bar and the rolls 11 are re-positioned by the motor 14 at a position of contact, which generally does not coincide with the position of insertion of the bar.

The drawing cylinder/piston actuator 30 now begins its drawing action and, by moving downstream, draws the bar with it, while the sharpening rolls 11 are rotated to bring the grooves 24 to the position pre-set by the setting of the selector 25 until the desired reduction of section has been achieved.

If necessary, a plurality of travels of the bar can be carried out by taking the bar back to its initial position.

I claim:

1. A machine to sharpen bars to a point, comprising:

at least one sharpening assembly comprising a pair of circumferentially tangent reduction rolls having parallel axes, each of said rolls containing, at a plane of positioning of a bar, a groove having, in a circumferential direction, at least two different sections, wherein said reduction rolls are rotatable about their axes so as to be able to effect a desired reduction of section of said bar by said reduction rolls;

an assembly for displacement of said bar in relation to said at least one sharpening assembly;

at least one upstream rolling assembly upstream of said at least one sharpening assembly; and at least one downstream rolling assembly downstream of said at least one sharpening assembly, each of said at least one upstream rolling assembly and said at least one downstream rolling assembly having a pair of rolls having axes at a right angle to the axes of said reduction rolls.

2. Sharpening machine as in claim 1, in which each respective groove has a depth and section which is increased in said circumferential direction in progressive connected steps.

3. Sharpening machine as in claim 1, in which the groove has a depth and section which is increased in said circumferential direction in a progressively constant and continuous manner.

4. Sharpening machine as in claim 1, in which a first of the reduction rolls is is driven by a motor for circumferential positioning, whereas a second reduction roll is associated with the first reduction roll by means of coaxial gearwheels.

5. Sharpening machine as in claim 4, in which the first reduction roll cooperates with a selector for selecting a desired circumferential position of the first reduction roll, the selector being associated with the motor for circumferential positioning.

6. Sharpening machine as in claim 4, in which at least the second reduction roll can be positioned radially in relation to the first reduction roll.

7. Sharpening machine as in claim 6, in which at least the second reduction roll is associated with a slide block cooperating with a piston which can move on a plane at a right angle to the axes of the reduction rolls.

8. Sharpening machine as in claim 1, in which the upstream rolling assembly carries out a pre-buckling action on the bar.

9. Sharpening machine as in claim 1, in which the downstream rolling assembly levels any burrs.

10. Sharpening machine as in claim 1, in which the upstream rolling assembly comprises a plurality of rolling mill stands arranged with their axes offset from each other so as to carry out a pre-buckling action on the bar at several circumferential zones on the bar.

11. Sharpening machine as in claim 10, in which the rolling mill stands upstream of the sharpening assembly are at least four in number.

12. Sharpening machine as in claim 1, in which the assembly for displacement of the bar in relation to the sharpening assembly comprises a drawing assembly, which includes an engagement gripper having an adjustable gripper width and a cylinder/piston actuator.

13. Sharpening machine as in claim 1, in which the drawing assembly is positioned downstream of the sharpening assembly.

* * * * *